US006059218A

United States Patent [19]

Berube

[11] Patent Number: 6,059,218

[45] Date of Patent: May 9, 2000

[54] AIRLOCK SHAFT WITH DIFFERENTIAL CORE SPEED SLIPPING CAPABILITY

[75] Inventor: Daniel J. Berube, Wilton, N.H.

[73] Assignee: Nim-Cor, Inc., Nashua, N.H.

[21] Appl. No.: 09/267,857

[22] Filed: Mar. 12, 1999

Related U.S. Application Data

[60] Provisional application No. 60/117,520, Jan. 28, 1999.

[51] Int. Cl.[7] ..... B65H 75/24

[52] U.S. Cl. ..... 242/530.3; 242/571.1; 279/2.07

[58] Field of Search ..... 242/530.3, 571.1, 242/571.2, 576.1; 279/2.06, 2.07, 2.08, 2.09, 2.23

[56] References Cited

U.S. PATENT DOCUMENTS

| | | | |
|---|---|---|---|
| 3,817,468 | 6/1974 | Smolderen et al. | 242/530.3 |
| 4,026,488 | 5/1977 | Hashimoto . | |
| 4,099,732 | 7/1978 | Threatt | 242/571.1 |
| 4,114,909 | 9/1978 | Taitel et al. . | |
| 4,135,677 | 1/1979 | Warczak . | |
| 4,175,712 | 11/1979 | Schippers et al. | 242/576.1 |
| 4,220,291 | 9/1980 | Papa | 242/530.3 |
| 4,767,077 | 8/1988 | Kataoka | 279/2.07 |
| 5,372,331 | 12/1994 | Miller et al. . | |
| 5,379,964 | 1/1995 | Pretto et al. | 242/571.2 |
| 5,445,342 | 8/1995 | Miller et al. . | |
| 5,735,184 | 4/1998 | Miller et al. . | |
| 5,979,823 | 11/1999 | Schlumpf et al. | 242/571.2 |

*Primary Examiner*—John M. Jillions
*Attorney, Agent, or Firm*—Vernon C. Maine; Scott J. Asmus

[57] ABSTRACT

An expandable airlock shaft with surface mounted roller bearings provides differential core speed slipping capability for adjacent core segments on a common shaft. The shaft may be used with an expandable collet system consisting of a set of relatively short, expandable collets, which are used with spacers where needed to accommodate multiple core segments in any desired arrangement. Alternatively, the roller bearings may be incorporated into the expandable collets, and the shaft configured with an expandable bearing support surface.

20 Claims, 13 Drawing Sheets

AIRLOCK SHAFT WITH DIFFERENTIAL CORE SPEED SLIPPING CAPABILITY

This application relates and claims priority to pending U.S. patent application Ser. No. 60/117,520, filed Jan. 28, 1999, by the same inventor.

BACKGROUND OF THE INVENTION

1. Field of the Invention

The present invention relates to drive mandrels or shafts that provide for gripping the internal surfaces of sleeves, tubes or cores on which web material may be wound, and yet allow for speed slippage between the shaft and core when web tension exceeds the torque being applied to the shaft. More particularly, the invention relates to means for gripping and independently slipping multiple cores on a common shaft.

2. Description of the Prior Art

Expandable shafts or mandrels are generally constructed with elements on the surface adapted to be extended radially outward by inflation of bladders within the shaft. Shaft designs fall into two general categories, the lug type and slotted rail type. The former contemplates a number of discreet lugs located at different points along the shaft. Customarily there are one or more bladders located within the shaft that are appropriately inflated to cause the lugs to extend radially outward to grip the web sleeve that surrounds the shaft. The slotted type of expandable shaft customarily includes a plurality of equally spaced slots around the circumference of the shaft and elongated pressure elements located within the slots.

Individual bladders located within the shaft slots are inflated to bear against the pressure elements and extend them radially outward for the gripping of a surrounding web sleeve. Helical slots have also been used in expandable core shafts in the past. The amount of pressure in the bladders generally controls the degree of grip or limit of torque that can be applied to the sleeve or core.

A problem unresolved in the art is the mixing of different sleeve lengths on a common shaft, to accommodate different web widths, materials, sheet thickness, and their effect on individual web tensions as the diameters of the different rolls and their different weights and inertia's change during the run.

U.S. Pat. Nos. 5,445,342; 4,135,677; 4,114,909; 4,026,488; 5,372,331; and 5,379,964; may provide further useful context for the introduction of the present invention.

SUMMARY OF THE INVENTION

The invention, simply explained, is an airlock shaft which provides for mounting multiple core segments of differing lengths onto a common shaft in any desired order, with independent speed slip capability for each core segment in response to changes in web tension as may be caused by different materials, web widths, changing roll size, and process conditions.

It is an object of the invention to provide an airlock core shaft system with speed slipping capability as between a core and the shaft, by configuring a distributed array of small, relatively short roller bearings parallel to the axis of the shaft, between the shaft and the core, which are then forced under pressure of the airlock mechanism against a bearing surface to cause limited resistance to free rotation of the core.

It is a further object of the invention to provide an airlock core shaft system for mounting multiple core segments and core spacers of various widths in any desired order within the limit of the shaft length, each retaining independent speed slipping capability in its place on the shaft, by configuring a distributed array of small, relatively short roller bearings parallel to the axis of the shaft, between the shaft and the core segments.

It is another object of the invention to provide an airlock core shaft system with core speed slipping capability by configuring an expandable roller bearing array and expandable bearing surface mechanism between the shaft and the core.

It is a yet further object to provide an airlock core shaft with differential core speed capability that reduces the amount of core dust commonly created due to core/clutch slippage.

Other objects and advantages of the present invention will become readily apparent to those skilled in this art from the following detailed description, wherein I have shown and described only a preferred embodiment of the invention, simply by way of illustration of the best mode contemplated by me on carrying out my invention.

DESCRIPTION OF THE PREFERRED EMBODIMENT

In a preferred embodiment, an air shaft is configured with multiple, longitudinal rows of elongate slots that are spaced uniformly around the circumference of the shaft, with each row of slots being offset longitudinally by a small amount from the adjacent rows so that the slots appear to be arranged in a staggered pattern, lengthwise on the shaft. The offset pattern allows expandable collets to be located anywhere along the lug surface, and still be over a multiplicity of slots. The result is a differential speed slip shaft that permits the use of universal and mixed core widths.

Each slot contains an extendible roller bearing mechanism consisting of a set of several small roller bearings mounted on a longitudinally oriented rod that is supported at each end by a post, the two posts being anchored to a respective base plate. An internal air bladder, when inflated, pushes the several rows of roller bearing mechanisms outward with universal force.

External of the shaft, there is a set of collets and spacers of such widths as are useful to the operator for mounting core segments of various widths on the shaft. Each collet is made up of a nylon inner sleeve, split on a diagonal to allow for slight expansion in circumference; a set of three stainless steel semi-circular sections fitted end to end to form the full circle of the collet; and an external, low durometer rubber band around the stainless steel sections that holds the collet together. Core segments are mated with similar size collets and assembled on the shaft. Inflation of the bladder extends the roller bearing mechanisms against the inside of the collets, expanding the collets and locking the outer band against the inner diameter of the core in a non-slip manner.

The air pressure used to inflate the bladder determines the tension at which the clutch collets will slip. Spacers are used to separate the collets and core segments to the user's specific requirements. The inner and outer diameters of the spacers are sized so as not to restrict extension of the roller bearing mechanisms and to not exceed the outside diameter of the collets when the roller bearing mechanisms are retracted and the collets are at their contracted, normal size.

The invention is susceptible of many variations. Accordingly, the drawings and following detailed description of the preferred embodiment are to be regarded as illustrative in nature, and not as restrictive.

Figure 1:
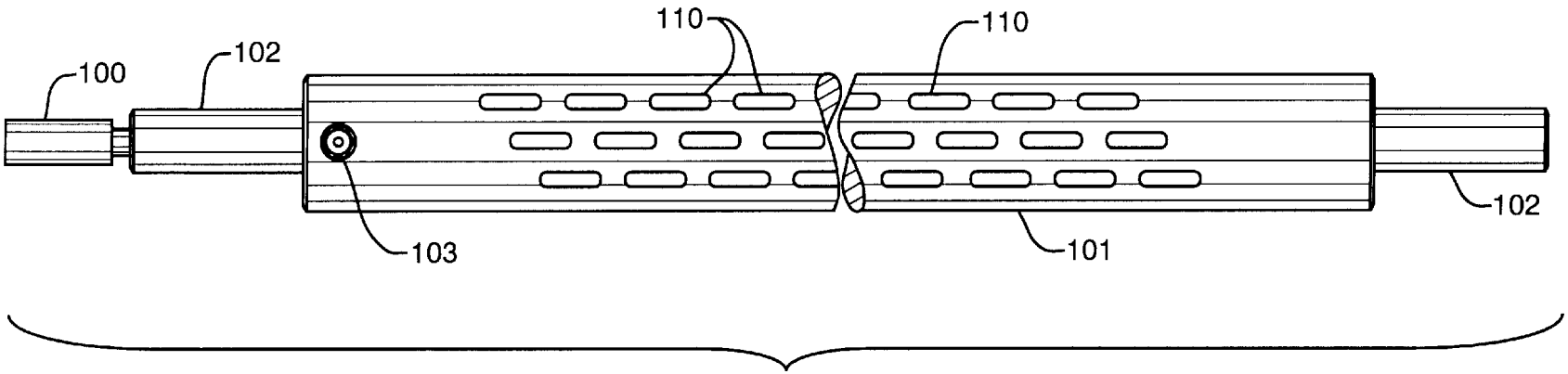
FIG. 1 is a top view shop drawing of a shaft of the preferred embodiment, illustrating the offset between adjacent rows of roller slots.
Figure 2:
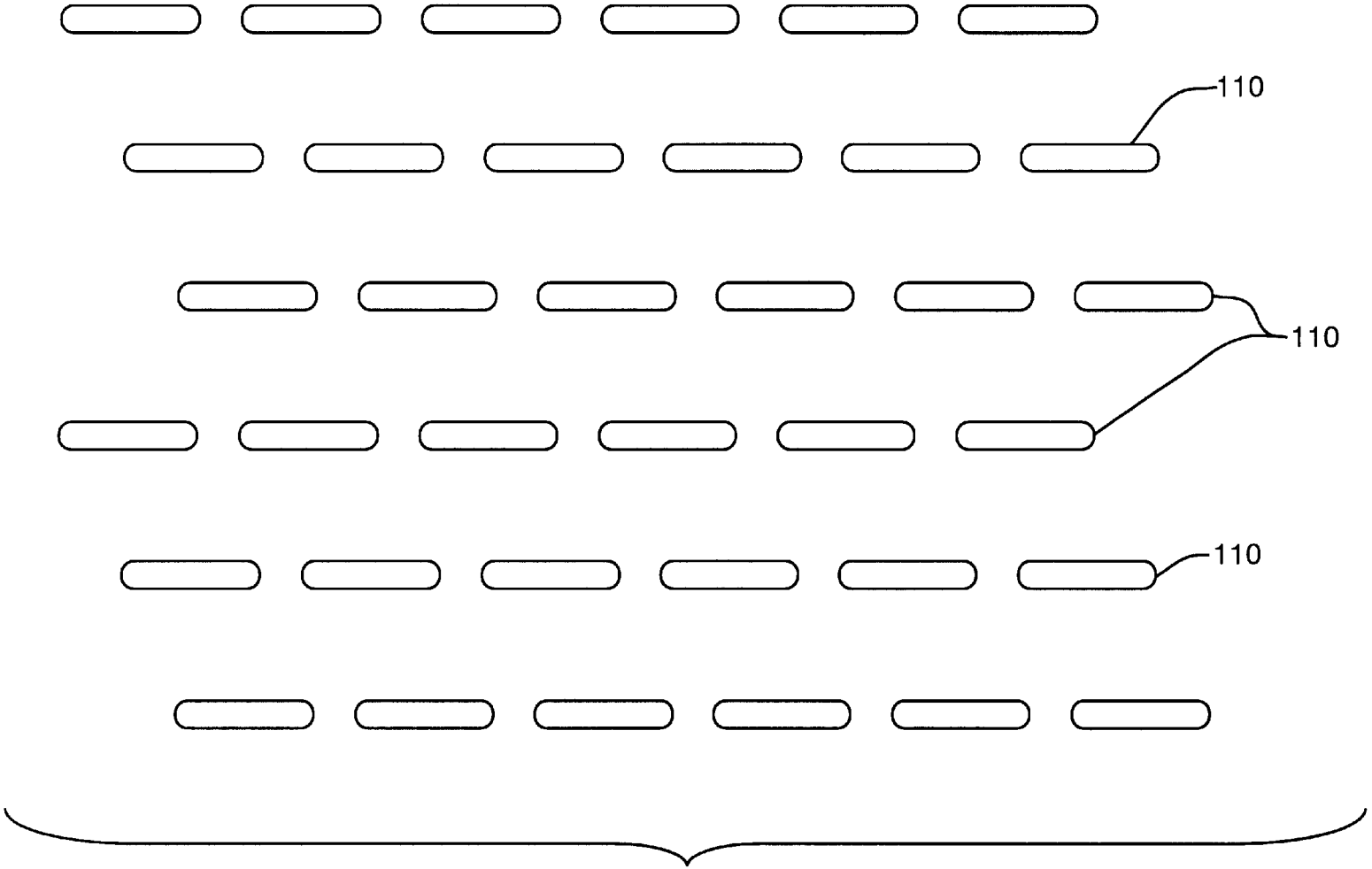
FIG. 2 is a planar presentation of the six rows of slots on the shaft of FIG. 1, illustrating the offset pattern of all rows.
Figure 4:
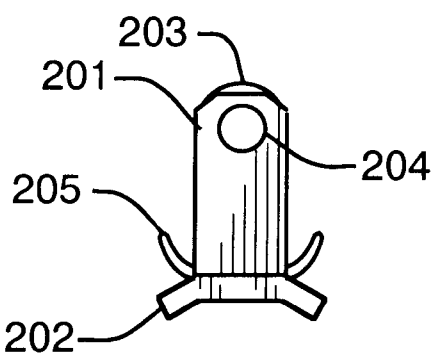
FIG. 4 is an end view of the roller assembly of FIG. 3.
Figure 3:
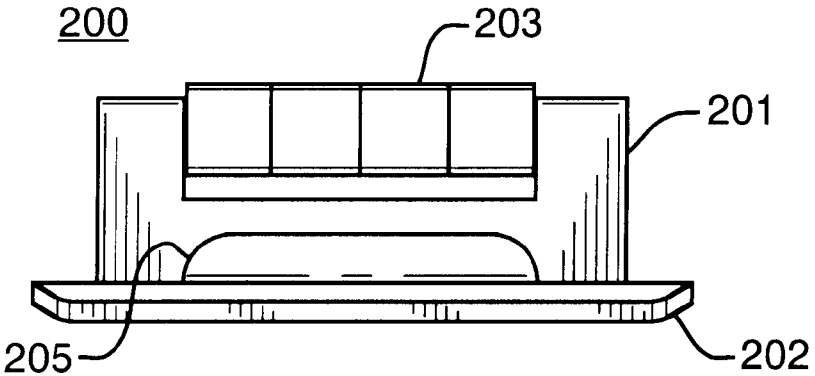
FIG. 3 is a side elevation of a roller assembly of the preferred embodiment.
Figure 5B:
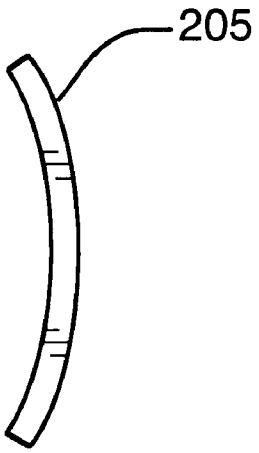
FIGS. 5A and 5B are a top view and end view of the spring of the roller assembly of FIG. 3, showing the radius of curvature of the spring.
Figure 5A:
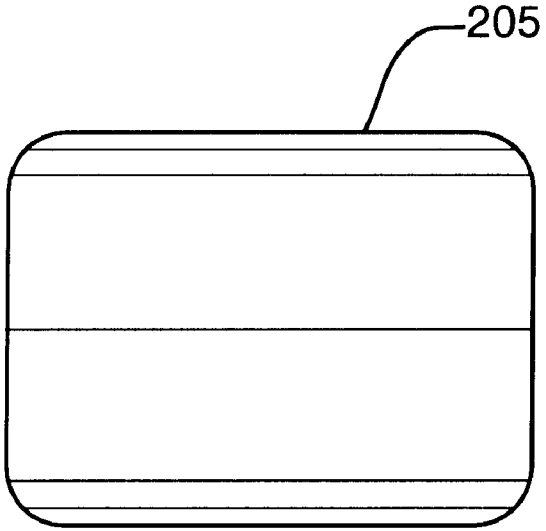
Figure 6B:
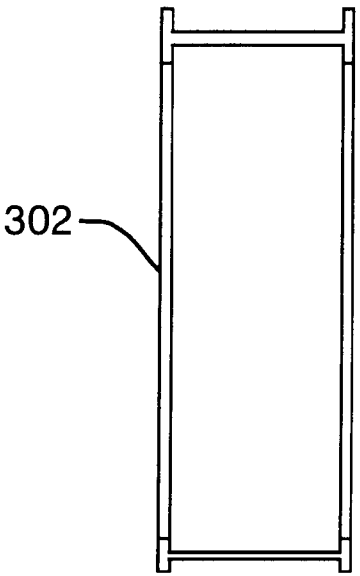
FIGS. 6A and 6B are an end view and side elevation illustrating the three tri-sections of the expandable collet of the preferred embodiment.
Figure 6A:
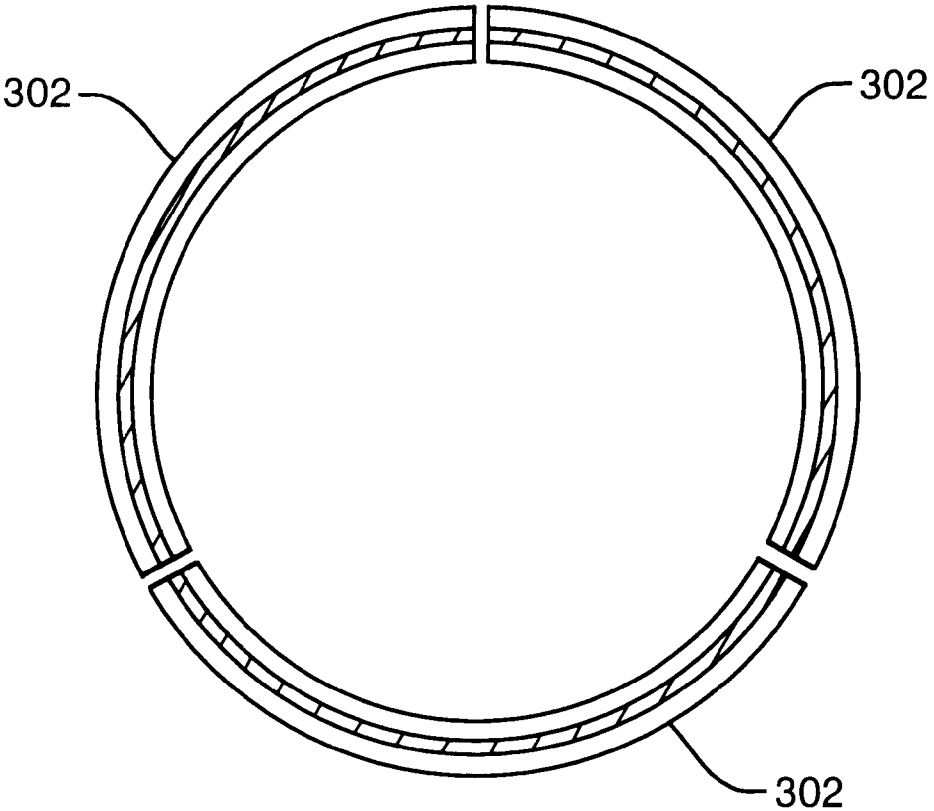
Figure 7B:
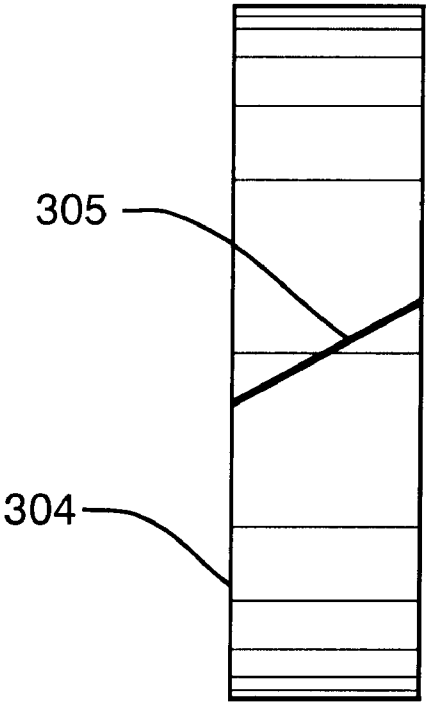
FIGS. 7A and 7B are an end view and side elevation illustrating the diagonally cut inner nylon bearing ring of the expandable collet of the preferred embodiment.
Figure 7A:
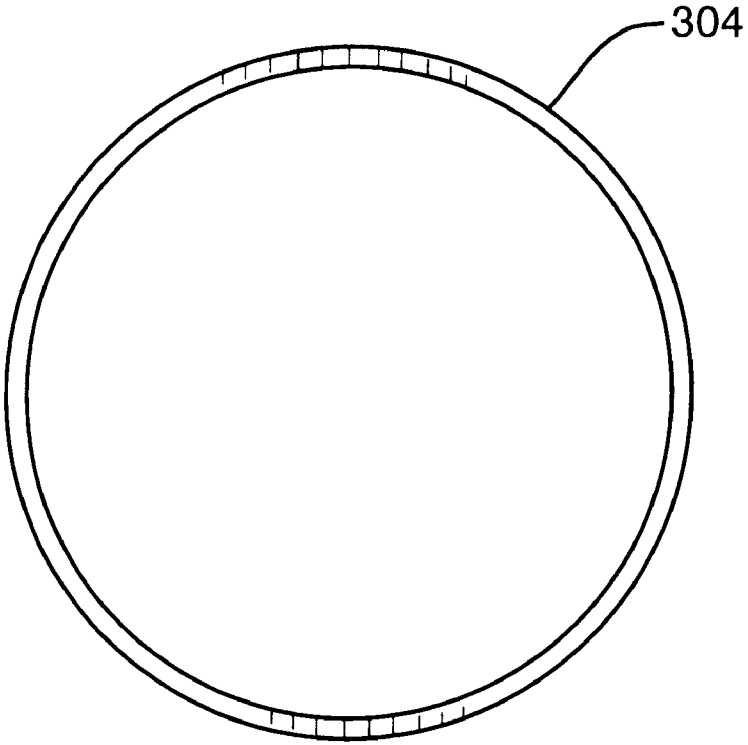
Figure 8B:
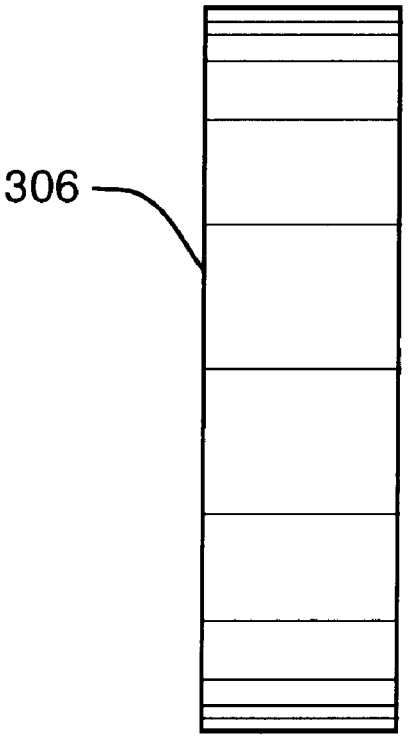
FIGS. 8A and 8B are an end view and side elevation illustrating the flexible outer gripping ring of the expandable collet of the preferred embodiment.
Figure 8A:
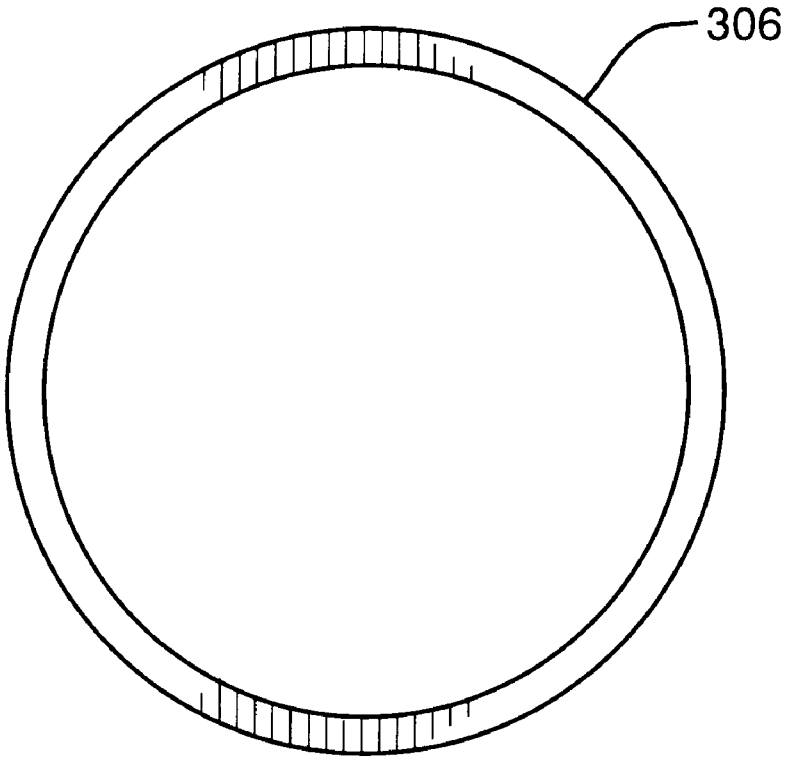

Referring to FIGS. 1 and 2, shaft assembly 100 has journals 102 protruding from each end of body 101. One or more air valves 103 are located near end points of body 101 for admitting and releasing air from flexible bladders (not shown) within body 101. Body 101 is of about two and one half inches diameter. Elongate slots 110 about one and one half inches long by about three eighths inch wide are configured in six longitudinal rows of slots uniformly spaced apart about 15/32 inches and extending substantially the length of body 101, with the six rows being equally spaced circumferentially about the body. The rows are arranged lengthwise in a progressive offset pattern, adjacent rows being offset about 15/16 inches, so that there are always a plurality of slots uniformly displaced about the circumference at every point lengthwise along the body.

Referring to FIG. 2, the general pattern of slots 110 is illustrated in a planar fashion, with spacing between slots being not longer than the slots, and the distance between each of the six rows being a function of the diameter of body 101 of FIG. 1.

Referring to FIGS. 3–5B, roller assembly 200 consists of lug 201, which is about one and one half inches long, mounted to lug flange 202 so as to sandwich a pair of stacked, curved springs 205, with the concave surface directed upward. Four roller bearings 203 are supported by drill rod 204, which is attached at its end points to the shoulders of lug 201.

Referring to FIGS. 6A–8B, collet assembly 300 consists of stainless steel tri-sections 302 which together form a full ring. The tri-sections have an H shaped cross section suitable to provide lateral retention of inner nylon ring 304 and outer band 306. Inner nylon ring 304 has a single diagonal cut 305, to allow for slight expansion. When assembled, tri-sections 302 are held in an expandable collet configuration between the inner ring 304 and the outer band 306.

Figure 9B:
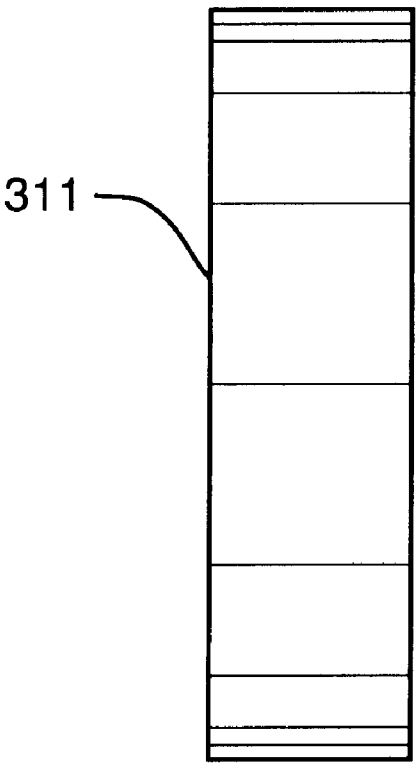
FIGS. 9A and 9B are an end view and side elevation illustrating a spacer ring of the preferred embodiment.
Figure 9A:
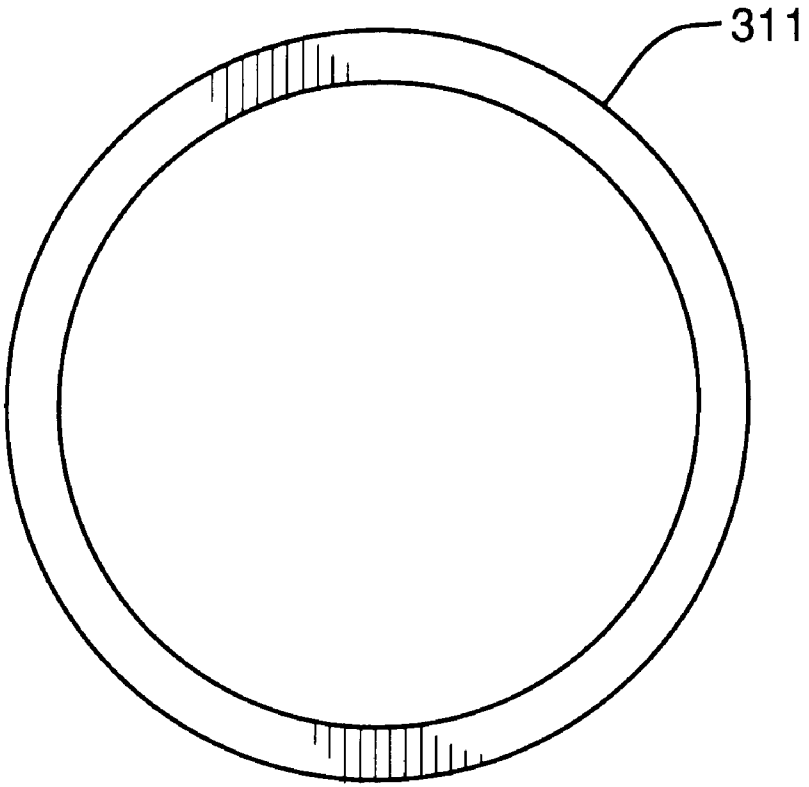

Referring to FIGS. 9A and 9B, spacer ring 311 is of slightly greater inner diameter and slightly smaller outer diameter as collet assembly 300, and is typically fabricated of an impregnated nylon to provide a self-lubricating characteristic that permits an easy differential speed relative to adjacent collets and core segments.

Figure 10B:
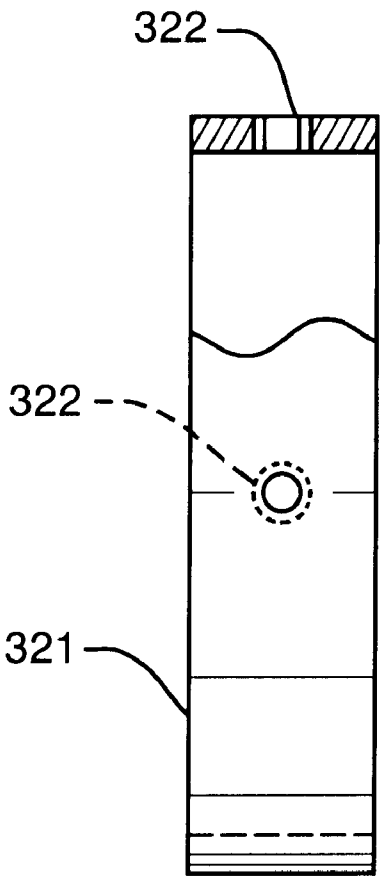
FIGS. 10A and 10B are an end view and side elevation illustrating a clamping collar of the preferred embodiment.
Figure 10A:
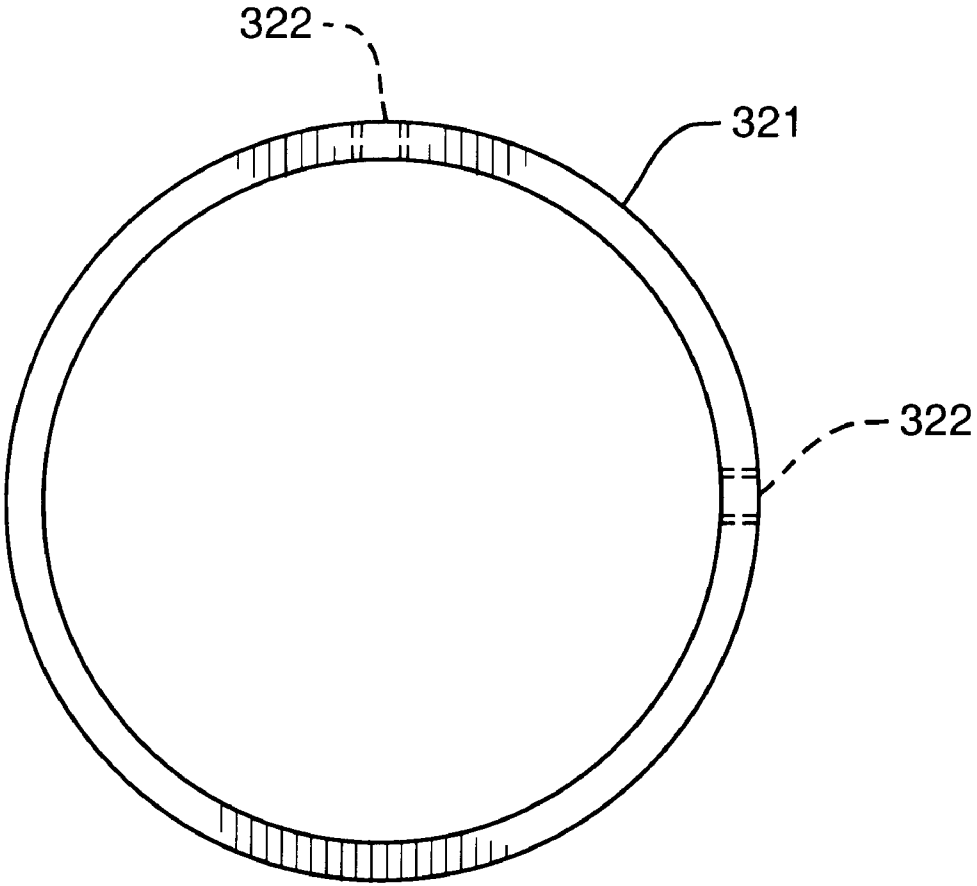

Referring to FIGS. 10A and 10B, clamping collar 321 is a mild steel ring component of substantially the same size as spacer ring 311, but is configured with tapped set screw holes 322 for securing a locking grip on shaft body 101.

Figure 11:
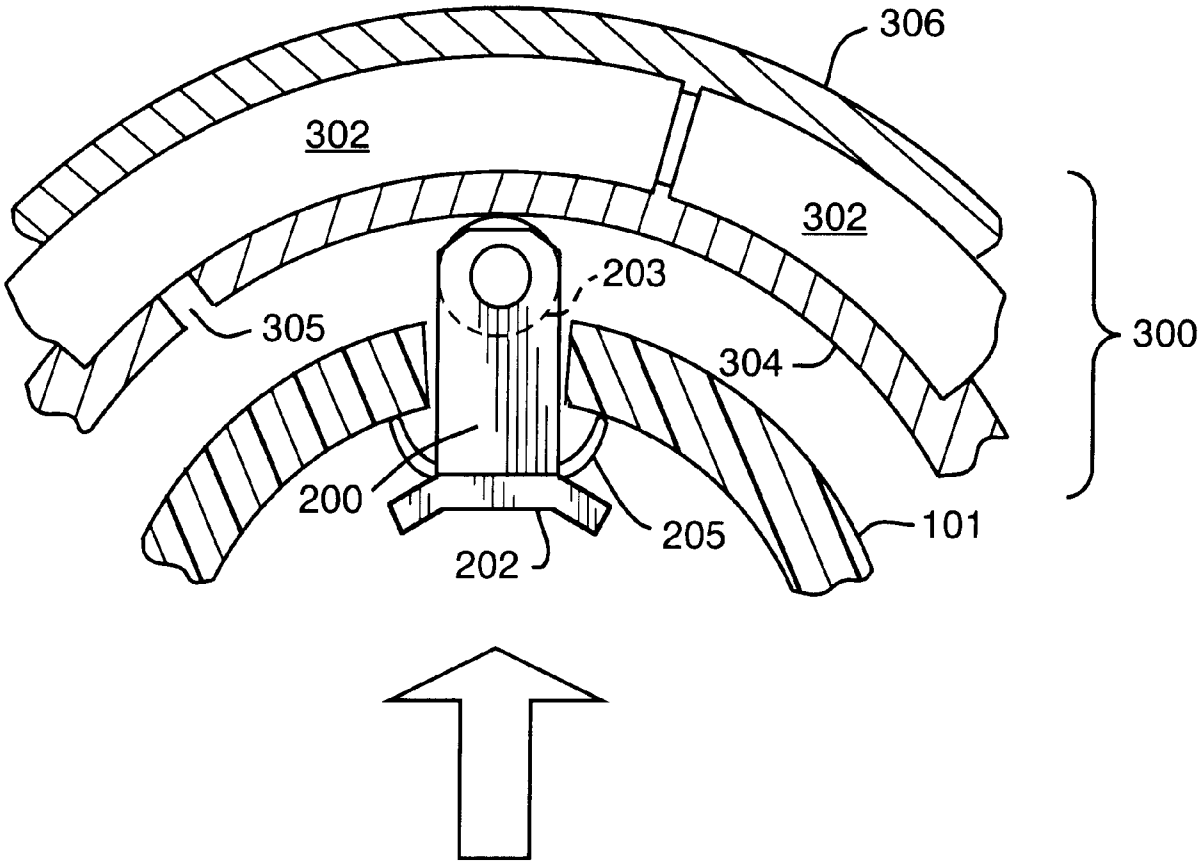
FIG. 11 is a partial cross section view of the preferred embodiment illustrating a roller assembly as installed on a shaft assembly.

Referring to FIG. 11, a portion of the body 101 of shaft assembly 100 is shown in cross section with roller assembly 200 exposed in an end view. When a pneumatic bladder or bladders suitable for the task and installed within the shaft exert universal outward force underneath lug flanges 202, roller bearings 203 exert expanding pressure on collet assembly 300, causing inner ring 304 to open slightly at diagonal cut 305, tri-sections 302 to separate slightly at their end points, and outer band 306 to expand into relatively tight contact with the subject core. Springs 205 prevent over extension of roller bearing assemblies 200, flexing under pressure into full contact against the inner diameter of shaft 101.

Roller bearings 203 of roller assembly 200 provide for a degree of slippage as between the collet assembly 300 and the shaft assembly 100. The pattern of roller assemblies over the full surface of the shaft assembly allows for adjacent cores and collets to slip different amounts relative to full shaft speed, as may be dictated by different web widths, tensions, process conditions, and materials from one core to the next. The diagonal angle on cut 305 of the inner ring 304 of the collet assembly provides for carrying the slight space in the cut easily over rollers 203.

A threshold amount of air pressure in the airshaft bladder or bladders provides uniform support of the core or cores on the shaft. The density and compression of the collet assembly components, under pressure of the small rollers of the roller assemblies, provides a resistance against slippage of core speed which varies with the amount of pressure exerted by the airshaft bladder.

Figure 12:
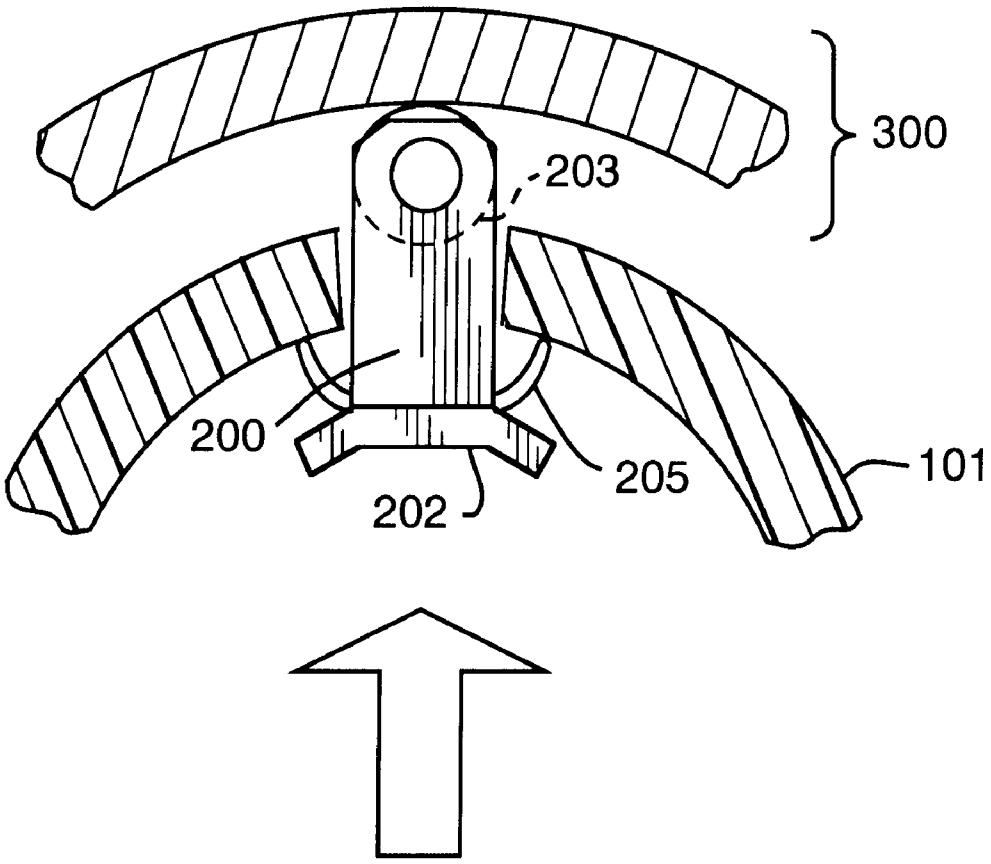
FIG. 12 is a partial cross section of a second embodiment of the invention, illustrating a core mounted directly on a roller bearing configured airlock shaft of the first embodiment.

Referring to FIG. 12, in a simplified embodiment of the invention, the user may mount one or more cores of compatible inner diameter size directly on the airlock shaft assembly 200, without using the collet assembly. Spacer rings 311 of the previous embodiment may be utilized to separate the cores. Clamping collars 321 of the previous embodiment may be used to retain the core or cores in position on the shaft, so long as adjacent cores or core segments are loosely enough arranged to allow different amounts of slippage without adjacent interference.

Figure 13:
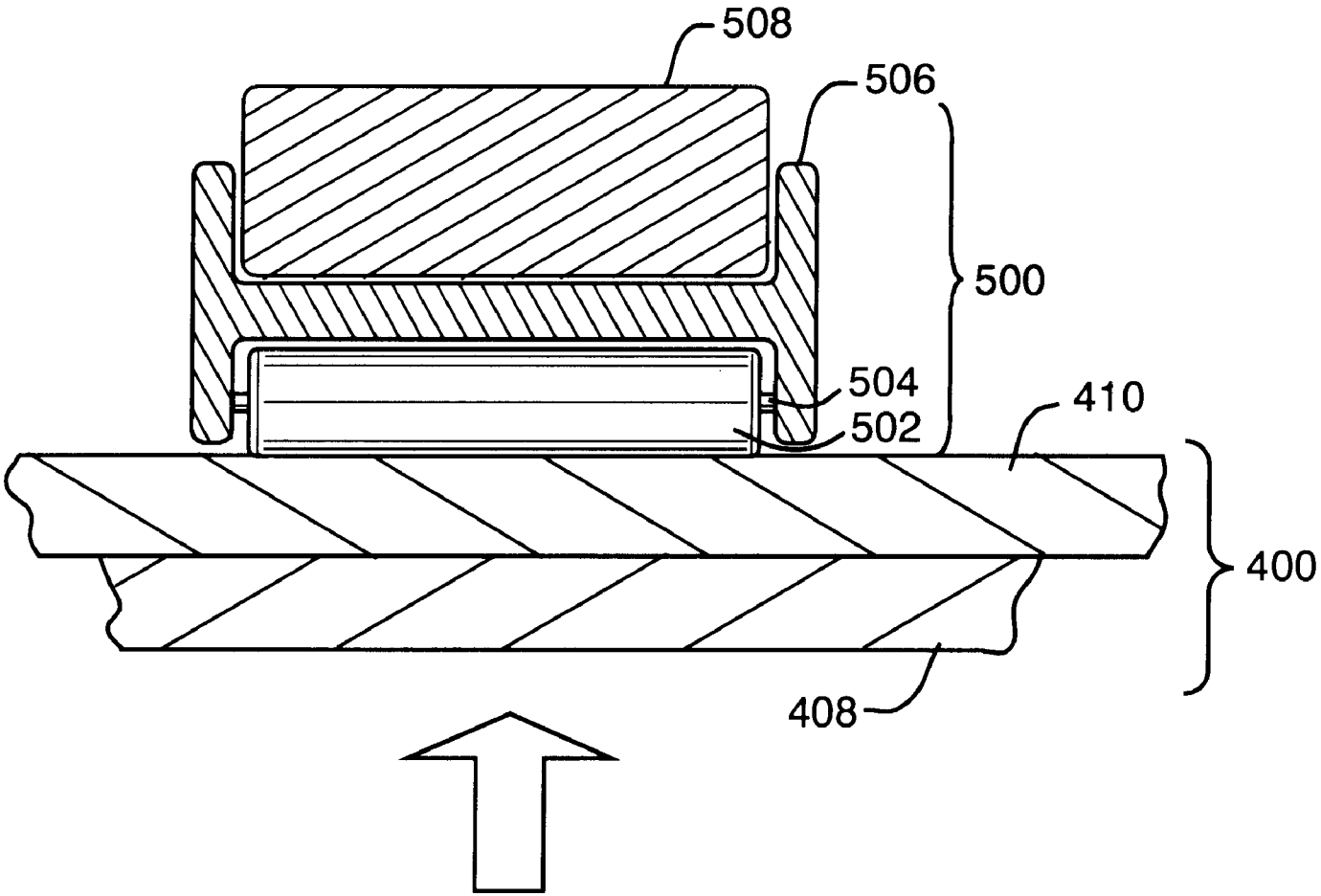
FIG. 13 is a longitudinal partial cross section view of a third embodiment of the invention, illustrating roller bearings integral to the collet assembly.
Figure 14:
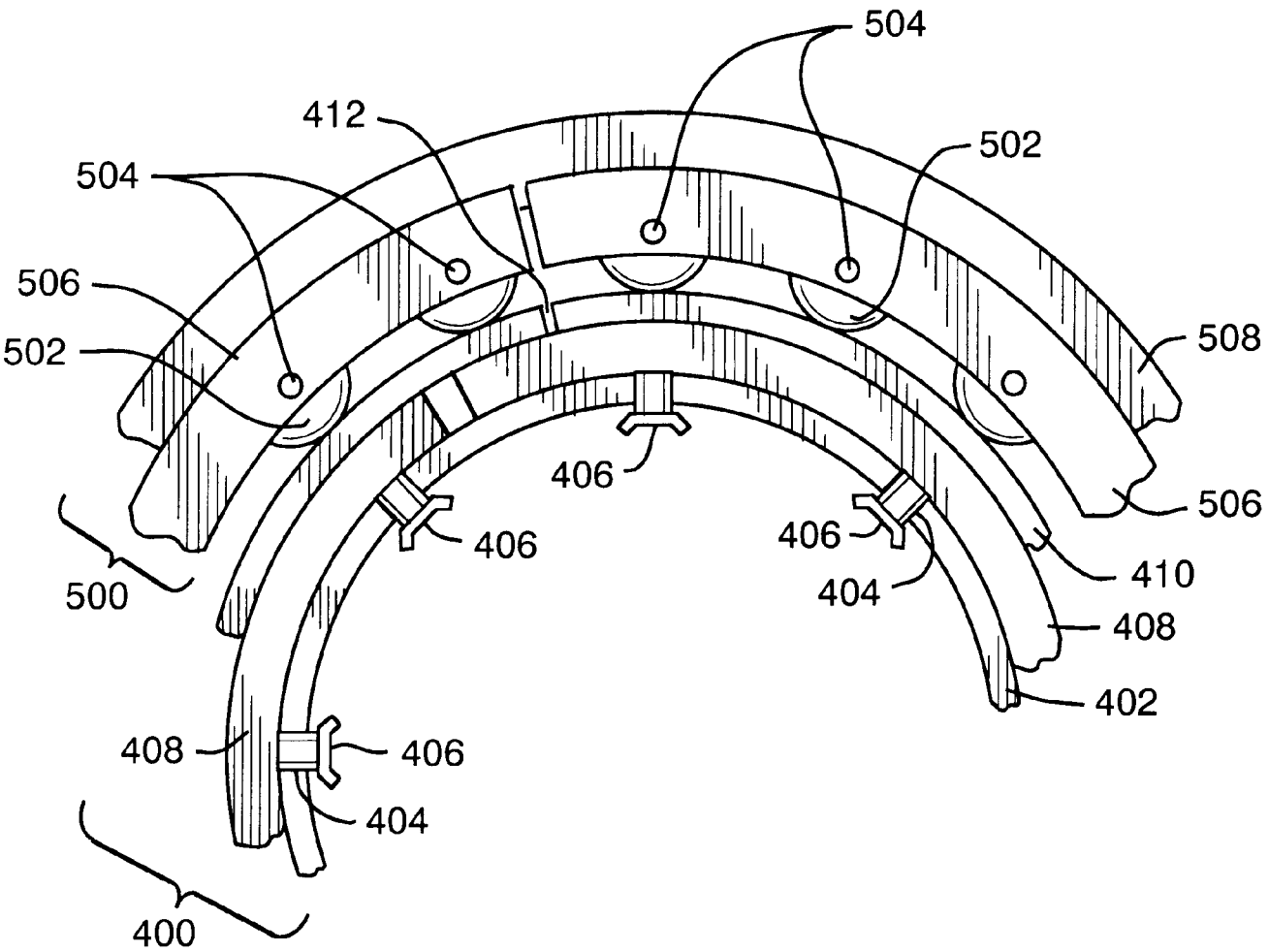
FIG. 14 is a lateral partial cross section view of the embodiment of FIG. 13.

Referring to FIGS. 13 and 14, in another embodiment of the invention, the roller bearings and inner ring of the previous embodiment have been reversed, and multiple outer shaft sections added to the shaft body assembly. Specifically, shaft assembly 400 includes a shaft body 402 with four, 90 degree outer shaft sections 408 secured through slots 404 by lifting lugs 406. A nylon sleeve 410 with a single longitudinal split 412 encloses the outer shaft sections

408. The four shaft sections 408 together encircle shaft body 402, and are of substantially the same length as shaft body 402.

Collet assembly 500 consists of multiple roller bearings 502, each secured by a rod 504 within and along the inner diameter flanges of collet tri-sections 506. The three trisections 506 are contained in their circular relationship by an outer band 508.

A pneumatic bladder (not shown) internal to the shaft body exerts expansion pressure on the outer shaft sections 408, expanding the nylon sleeve 410, slightly; and consequently expanding the collet assembly slightly as well. The roller bearings 502 provide for a slipping capability of the collet and its core on the shaft assembly, the extent of which is variable with the air pressure in the bladder.

As will be realized, the invention is capable of other and different embodiments, and its several details are capable of modifications in various obvious respects, all without departing from the essence of the invention.

As an example, there is within the scope of the invention a core lock and speed slipping shaft system for mounting cores for rolling sheet material, consisting of a tube shaft with end journals, where the shaft is configured with an internal fluid operated core locking mechanism and a multiplicity of roller bearing assemblies with roller bearings oriented parallel to the axis of the shaft and uniformly distributed around and protruding through slots in the shaft to slightly above the surface of the shaft so as to provide rolling support to the cores for free rotation about the shaft, the roller bearing assemblies being extendible outward from the shaft under hydraulic pressure applied by the core locking mechanism so as to introduce resistance to the free rotation of cores on the shaft.

The core lock and speed slipping shaft system of the invention may further include an expandable collet system that fits within the cores and over the shaft and roller bearing assemblies, against which the roller bearing assemblies bear when under pressure from the core locking mechansim, and where the collet system is expandable into locking engagement with the core.

Such an expandable collet system may include a spring-like one piece inner sleeve, the ends of which are abutted at an angle other than perpendicular so as to avoid having a gap parallel to the roller bearings, a segmented collar or collet comprising at least three semicircular segments abutted end to end in a circular relationship, and a means such as a common spring or separate attachments at each joint, or a rubber band or elastic wrap for containing the semicircular segments in a circular relationship and basically holding the collet together prior to installation and the application of pressure.

Each roller bearing assembly would include one or more roller bearings mounted on a supporting lug. The several roller bearing assemblies would be arranged as three or more, six in the preferred embodiment, longitudinal lines of spaced apart assemblies, where the lines are spaced equidistant about the circumference of the shaft.

Each line could have uniformly spaced apart roller bearing assemblies, the spacing between assemblies being less than the length of one assembly, and adjacent lines could be longitudinally offset from each other by more than the length of spacing and less than the length of an assembly, so that where ever there is a gap of roller bearings in one line, an adjacent line will have roller bearings present.

Also, the supporting lug protruding through the slot on the shaft may have attached at its base a spring, or a spring set that might be two springs in a stack, and a base flange, where the base flange is the contact point for the core locking mechanism when it expands, and where the spring or spring set is sized and biased so as to be compressed against the inner surface of the shaft on either side of the slot when the roller bearing assembly is extended.

As another example, there is within the scope of the invention an airlock core shaft with speed slipping capability for mounting cores for rolling sheet material, consisting of a tube shaft with end journals and an internal airlock mechanism such as a flexible bladder pressurized from an air valve on the end of the shaft, where the shaft is configured with a uniformly distributed array of roller bearing assemblies extendible from the surface of the shaft by actuation of the internal airlock mechanism, where the roller bearing assemblies are oriented to provide free rotation of the cores on the shaft when the airlock mechanism is not actuated, and where the roller bearing assemblies introduce limited resistance to free rotation of the cores on the shaft when the airlock mechanism is actuated.

As yet another example, there is within the scope of the invention an airlock core shaft and expandable collet combination with core speed slipping capability consisting of a tube shaft with end journals and an internal airlock mechanism, and at least one expandable collet. The shaft is configured with a uniformly distributed array of roller bearing assemblies extendible from the surface of the shaft by actuation of the internal airlock mechanism, and the roller bearing assemblies are oriented parallel to the axis of the shaft.

The expandable collets are sized to fit within a compatible core size and over the shaft and roller bearing assemblies. The roller bearing assemblies bear outwardly against the expandable collets when the airlock mechanism is actuated, expanding the collets into locking engagement with the core or multiple cores on the shaft.

The roller bearing assemblies provide free rotation of the collet on the shaft and allow for lateral positioning of the core on the collet when the airlock mechanism is not actuated. The roller bearing assemblies introduce resistance to the free rotation of the collet and core with respect to the shaft, when the airlock mechanism is actuated, the amount of resistance dependent principly on the amount of pressure in the airlock mechanism.

As still yet another example, it is within the scope of the invention to utilize a two part collet or compound collet system on a conventional expandible sleeve airlock shaft, where the collet system consists of an inner expandable collet component and an outer expandable collet component, with roller bearings and bearing surfaces disbursed between the inner and outer components so as to provide for speed slipping as between the components.

These compound collets can be stacked, with spacers if needed, to fit core segments in the same manner as in other embodiments of the invention using expandable collets, expanding to grip the core when the airlock mechanism is actuated, but having integral capability for allowing speed slippage in an amount proportional to the pressure applied by the airlock mechanism.

As a further example, it is within the scope of the invention to dispense with the collet assembly and mount one or more cores, with or without spacers, directly on the airlock shaft of the invention. The cores may have an inner diameter surface treatment or special sleeve to facilitate being supported on and slipping on the shaft's roller bearing array.

As a yet further example, it is within the scope of the invention to use larger or small roller bearings, longer or shorter roller bearing assemblies, more or less spacing between roller bearing assemblies, and additional or fewer rows of roller assemblies on the shaft body, with the same or different offset patterns between adjacent rows, so long as the geometry is within the parameters needed to accommodate the user's desired combinations of core widths and spacer widths.

As a still yet further example, the roller bearings may be incorporated into the collet assembly, and used in conjunction with expandable outer bearing surface sections on the shaft body. The collet assemblies can fabricated in multiple widths for different core lengths, and ganged together to accommodate longer cores.

As an even still yet further example, the means by which core locking with roller bearings is accomplished, may by be one or more bladders or fluid cylinders incorporated into the shaft assembly, using air or other suitable fluid medium to provide the necessary hydraulic effect.

In summary, the invention provides a core lock shaft with a differential speed slipping capability as between adjacent cores on the shaft, and the ability to stack or arrange cores and spacers on the shaft to suit the needs of the user. The scope of the invention will be apparent to those skilled in the art as inclusive of the preferred embodiment and the several variations explained and implied, as defined by the claims appended hereto.

I claim:

1. A core lock and speed slipping shaft system for mounting cores for rolling sheet material, comprising a tube shaft with end journals, said shaft configured with an internal fluid operated core locking mechanism and a multiplicity of roller bearing assemblies with roller bearings oriented parallel to the axis of said shaft and uniformly distributed around and protruding through slots in said shaft to slightly above the surface of said shaft so as to provide rolling support to said cores for free rotation about said shaft, said roller bearing assemblies being extendible outward from said shaft under fluid pressure applied by said core locking mechanism so as to introduce resistance to said free rotation of said cores.

2. The core lock and speed slipping shaft system of claim 1, further comprising an expandable collet system that fits within said cores and over said shaft and said roller bearing assemblies, against which said roller bearing assemblies bear when under said pressure, said collet system being expandable into locking engagement with said core.

3. The core lock and speed slipping shaft system of claim 2, said expandable collet system comprising:

a one piece inner sleeve the ends of which are abutted at an angle other than perpendicular, a collet comprising at least three semicircular segments abutted end to end in a circular relationship, and means for containing said semicircular segments in said circular relationship prior to the application of said pressure.

4. The core lock and slipping shaft system of claim 3, said means for containing said semicircular segments comprising an outer elastic band.

5. The core lock and slipping shaft system of claim 1, each said roller bearing assembly comprising at least one roller bearing and a supporting lug, said multiplicity of roller bearing assemblies comprising at least three longitudinal lines of spaced apart said assemblies, said lines spaced equidistant about the circumference of said shaft.

6. The core lock and slipping shaft system of claim 5, said multiplicity of roller bearing assemblies comprising six said longitudinal lines, each said line comprising uniformly spaced apart said assemblies the spacing of which is less than the length of one said assembly, adjacent said lines being longitudinally offset from each other by more than one said spacing and less than one said length of a said assembly.

7. The core lock and slipping shaft system of claim 6, each said supporting lug protruding through a said slot and having attached at its base a spring and a base flange, said base flange contacting said core locking mechanism, said spring sized and biased so as to be compressed against the inner surface of said shaft on either side of said slot when said roller bearing assembly is extended.

8. An airlock core shaft with speed slipping capability for mounting cores for rolling sheet material, comprising a tube shaft with end journals and an internal airlock mechanism, said shaft configured with a uniformly distributed array of roller bearing assemblies extendible from the surface of said shaft by actuation of said internal airlock mechanism, said roller bearing assemblies oriented to provide free rotation of said cores on said shaft when said airlock mechanism is not actuated, said roller bearing assemblies introducing limited resistance to said rotation when said airlock mechanism is actuated.

9. The airlock core shaft with speed slipping capability of claim 8, further comprising an expandable collet system that fits within said cores and over said shaft and said roller bearing assemblies, against which said roller bearing assemblies bear when said airlock mechanism is actuated thereby expanding said collet system into locking engagement with said core.

10. The airlock core shaft with speed slipping capability of claim 9, said expandable collet system comprising:

a one piece inner sleeve the ends of which are abutted at an angle other than perpendicular, a collet comprising at least three semicircular segments abutted in a circular relationship, and means for containing said semicircular segments in a circular relationship prior to the application of said pressure.

11. The airlock core shaft with speed slipping capability of claim 10, said means for containing said semicircular segments comprising an outer elastic band for containing said segments in said circular relationship.

12. The airlock core shaft with speed slipping capability of claim 9, said roller bearing assemblies comprising at least one roller bearing mounted on a supporting lug, said multiplicity of roller bearing assemblies comprising an array of at least three longitudinal lines of uniformly spaced apart said assemblies, said lines spaced equidistant about the circumference of said shaft.

13. The airlock core shaft with speed slipping capability of claim 12, said multiplicity of roller bearing assemblies comprising six said longitudinal lines, each said line comprising uniformly spaced apart said assemblies the spacing of which is less than the length of one said assembly, adjacent said lines being longitudinally offset from each other by more than one said spacing and less than one said length of a said assembly.

14. The airlock core shaft with speed slipping capability of claim 13, each said supporting lug protruding through a said slot and having attached at its base a spring and a base flange, said base flange contacting said airlock mechanism, said spring sized and biased so as to be compressed against the inner surface of said shaft on either side of said slot when said roller bearing assembly is extended.

15. An airlock core shaft and expandable collet combination with core speed slipping capability comprising:

a tube shaft with end journals and an internal airlock mechanism, said shaft configured with a uniformly distributed array of roller bearing assemblies extendible from the surface of said shaft by actuation of said internal airlock mechanism, said roller bearing assemblies oriented parallel to the axis of said shaft, at least one expandable collet that fits within a core and over said shaft and said roller bearing assemblies, against which said roller bearing assemblies bear when said airlock mechanism is actuated thereby expanding said collet into locking engagement with said core, said roller bearing assemblies providing free rotation of said collet on said shaft when said airlock mechanism is not actuated, said roller bearing assemblies introducing limited resistance to said rotation of said collet and said core when said airlock mechanism is actuated.

16. The airlock core shaft with speed slipping capability of claim 15, said expandable collet comprising:

a one piece inner sleeve the ends of which are abutted at an angle other than perpendicular, a segmented collar comprising at least three semicircular segments abutted in a circular relationship, and means for containing said semicircular segments in a circular relationship prior to the application of said pressure.

17. The airlock core shaft with speed slipping capability of claim 16, said means for containing said semicircular segments comprising an outer elastic band for containing said segments in said circular relationship.

18. The airlock core shaft with speed slipping capability of claim 15, said roller bearing assemblies comprising at least one roller bearing mounted on a supporting lug, said multiplicity of roller bearing assemblies comprising an array of at least three longitudinal lines of uniformly spaced apart said assemblies, said lines spaced equidistant about the circumference of said shaft.

19. The airlock shaft with speed slipping capability of claim 18, said multiplicity of roller bearing assemblies comprising six said longitudinal lines, each said line comprising uniformly spaced apart said assemblies the spacing of which is less than the length of one said assembly, adjacent said lines being longitudinally offset from each other by more than one said spacing and less than one said length of a said assembly.

20. The airlock shaft with speed slipping capability of claim 19, each said supporting lug protruding through a said slot and having attached at its base a spring and a base flange, said base flange contacting said airlock mechanism, said spring sized and biased so as to be compressed against the inner surface of said shaft on either side of said slot when said roller bearing assembly is extended.

* * * * *